US010012943B2

(12) United States Patent
Koyama

(10) Patent No.: US 10,012,943 B2
(45) Date of Patent: Jul. 3, 2018

(54) FIXING DEVICE PROVIDED WITH A PLURALITY OF HEATERS

(71) Applicant: BROTHER KOGYO KABUSHIKI KAISHA, Nagoya-shi, Aichi-ken (JP)

(72) Inventor: Tatsuya Koyama, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/467,549

(22) Filed: Mar. 23, 2017

(65) Prior Publication Data

US 2017/0277109 A1 Sep. 28, 2017

(30) Foreign Application Priority Data

Mar. 28, 2016 (JP) ..... 2016-063196

(51) Int. Cl.

| | |
|---|---|
| ***G03G 15/20*** | (2006.01) |
| ***G03G 15/00*** | (2006.01) |
| ***H01R 4/02*** | (2006.01) |
| ***H01R 4/34*** | (2006.01) |

(52) U.S. Cl.

CPC ..... *G03G 15/80* (2013.01); *G03G 15/2053* (2013.01); *H01R 4/023* (2013.01); *H01R 4/34* (2013.01)

(58) Field of Classification Search

CPC ..... G03G 15/80; G03G 15/2053
See application file for complete search history.

(56) References Cited

U.S. PATENT DOCUMENTS

2005/0084279 A1* 4/2005 Cho ..... G03G 15/2053 399/90
2005/0232652 A1* 10/2005 Chung ..... G03G 15/2064 399/90
2006/0140690 A1* 6/2006 Ito ..... G03G 15/2053 399/330
2010/0239316 A1 9/2010 Noso
2015/0093161 A1* 4/2015 Takeuchi ..... G03G 15/2053 399/328

(Continued)

FOREIGN PATENT DOCUMENTS

JP 2010-217491 A 9/2010
JP 2010-217492 A 9/2010

*Primary Examiner* — Sevan A Aydin
(74) *Attorney, Agent, or Firm* — Merchant & Gould P.C.

(57) ABSTRACT

A fixing device includes: first and second heaters; a frame; and first and second terminals. The frame includes first and second fixing surfaces. The first terminal is electrically-connected to the first heater and includes: a first plate-shaped portion including a first fixed portion fixed to the first fixing surface. The second terminal is electrically-connected to the second heater and includes: a second plate-shaped portion including a second fixed portion fixed to the second fixing surface; and a first electrical connection portion electrically-connected to a power source and including: a first intermediate portion bent from the second plate-shaped portion and extending in a first direction connecting the second fixed portion and the second fixing surface; and a first tip portion. The first intermediate portion has: a first end connected to the second plate-shaped portion; and a second end from which the first tip portion extends along the first plate-shaped portion.

18 Claims, 6 Drawing Sheets

(56) References Cited

U.S. PATENT DOCUMENTS

| | | | | |
|---|---|---|---|---|
| 2015/0139681 | A1* | 5/2015 | Mizuta | G03G 21/1867 399/90 |
| 2016/0033909 | A1* | 2/2016 | Kondo | G03G 15/2053 399/330 |
| 2016/0252855 | A1* | 9/2016 | Ishida | G03G 15/2053 399/329 |
| 2017/0336749 | A1* | 11/2017 | Ando | G03G 15/80 |
| 2018/0046127 | A1* | 2/2018 | Koyama | G03G 15/2053 |

* cited by examiner

FIXING DEVICE PROVIDED WITH A PLURALITY OF HEATERS

CROSS REFERENCE TO RELATED APPLICATION

This application claims priority from Japanese Patent Application No. 2016-063196 filed Mar. 28, 2016. The entire content of the priority application is incorporated herein by reference.

TECHNICAL FIELD

The present disclosure relates to a fixing device.

BACKGROUND

A fixing device that is provided in a printer or a copier is well known in the art. One such fixing device known in the art is provided with a plurality of heaters. Specifically, one such fixing device is provided with a first heater having an elongated configuration; a second heater having an elongated configuration and aligned in an elongated direction of the first heater; a frame having a first fixing surface and a second fixing surface; a first terminal member; and a second terminal member.

The first terminal member includes a first plate-shaped portion having a first fixed portion to which one end portion of the first heater in the elongated direction is fixed. The first fixed portion is fixed to the first fixing surface of the frame. The second terminal member includes a second plate-shaped portion having a second fixed portion to which one end portion of the second heater in the elongated direction is fixed. The second fixed portion is fixed to the second fixing surface of the frame. The second terminal member also includes a second electrical connection portion which is electrically connected to a power source. The second electrical connection portion is bent from the second plate-shaped portion and extends in a direction perpendicular to the second plate-shaped portion. A tip portion of the second electrical connection portion is electrically connected to the power source.

SUMMARY

In the fixing device provided with the second electrical connection portion described above, the tip portion of the second electrical connection portion also extends in a direction perpendicular to the first plate-shaped portion. Accordingly, there may be a problem in that a space around the first and second terminal members cannot be saved in the direction perpendicular to the first plate-shaped portion.

In view of the foregoing, it is an object of the disclosure to provide a fixing device including a first heater and a second heater and capable of saving a space around terminal members in the fixing device.

In order to attain the above and other objects, the disclosure provides a fixing device including: a first heater; a second heater; a frame; a first terminal member; and a second terminal member. The first heater has one end portion. The second heater has one end portion. The frame includes a first fixing surface and a second fixing surface. The one end portion of the first heater is fixed to the first terminal member. The first terminal member is electrically connected to the first heater. The first terminal member includes: a first plate-shaped portion having a plate shape and including a first fixed portion fixed to the first fixing surface of the frame. The one end portion of the second heater is fixed to the second terminal member. The second terminal member is electrically connected to the second heater. The second terminal member includes: a second plate-shaped portion having a plate shape and including a second fixed portion fixed to the second fixing surface of the frame; and a first electrical connection portion having a plate shape and electrically connected to a power source. The first electrical connection portion includes: a first intermediate portion; and a first tip portion. The first intermediate portion is bent from the second plate-shaped portion and extends in a first direction connecting the second fixed portion and the second fixing surface. The first intermediate portion has: a first end in the first direction and connected to the second plate-shaped portion; and a second end opposite to the first end of the first intermediate portion in the first direction. The first tip portion extends from the second end of the first intermediate portion along the first plate-shaped portion.

According to another aspect, the disclosure provides a fixing device including: a first heater; a second heater; a frame; a first terminal; and a second terminal. The first heater includes: a first glass tube elongated in an elongated direction and having one end in the elongated direction; a first heating body disposed inside the first glass tube; and a first lead pin protruding from the one end of the first glass tube and electrically connected to the first heating body. The second heater includes: a second glass tube elongated in the elongated direction and having one end in the elongated direction; a second heating body disposed inside the second glass tube; and a second lead pin protruding from the one end of the second glass tube and electrically connected to the second heating body. The frame includes a first fixing surface and a second fixing surface. The first terminal has a plate shape and to which the first lead pin is fixed. The first terminal is electrically connected to the first lead pin. The first terminal includes: a first plate-shaped portion having a plate shape and including a first fixed portion fixed to the first fixing surface of the frame. The second terminal has a plate shape and to which the second lead pin is fixed. The second terminal is electrically connected to the second lead pin. The second terminal includes: a second plate-shaped portion having a plate shape and including a second fixed portion fixed to the second fixing surface of the frame; and a first electrical connection portion having a plate shape and electrically connected to a power source. The first electrical connection portion includes: a first intermediate portion; and a first tip portion. The first intermediate portion is bent from the second plate-shaped portion and extends in a first direction connecting the second fixed portion and the second fixing surface. The first intermediate portion has: a first end in the first direction and connected to the second plate-shaped portion; and a second end opposite to the first end of the first intermediate portion in the first direction. The first tip portion extends from the second end of the first intermediate portion along the first plate-shaped portion.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
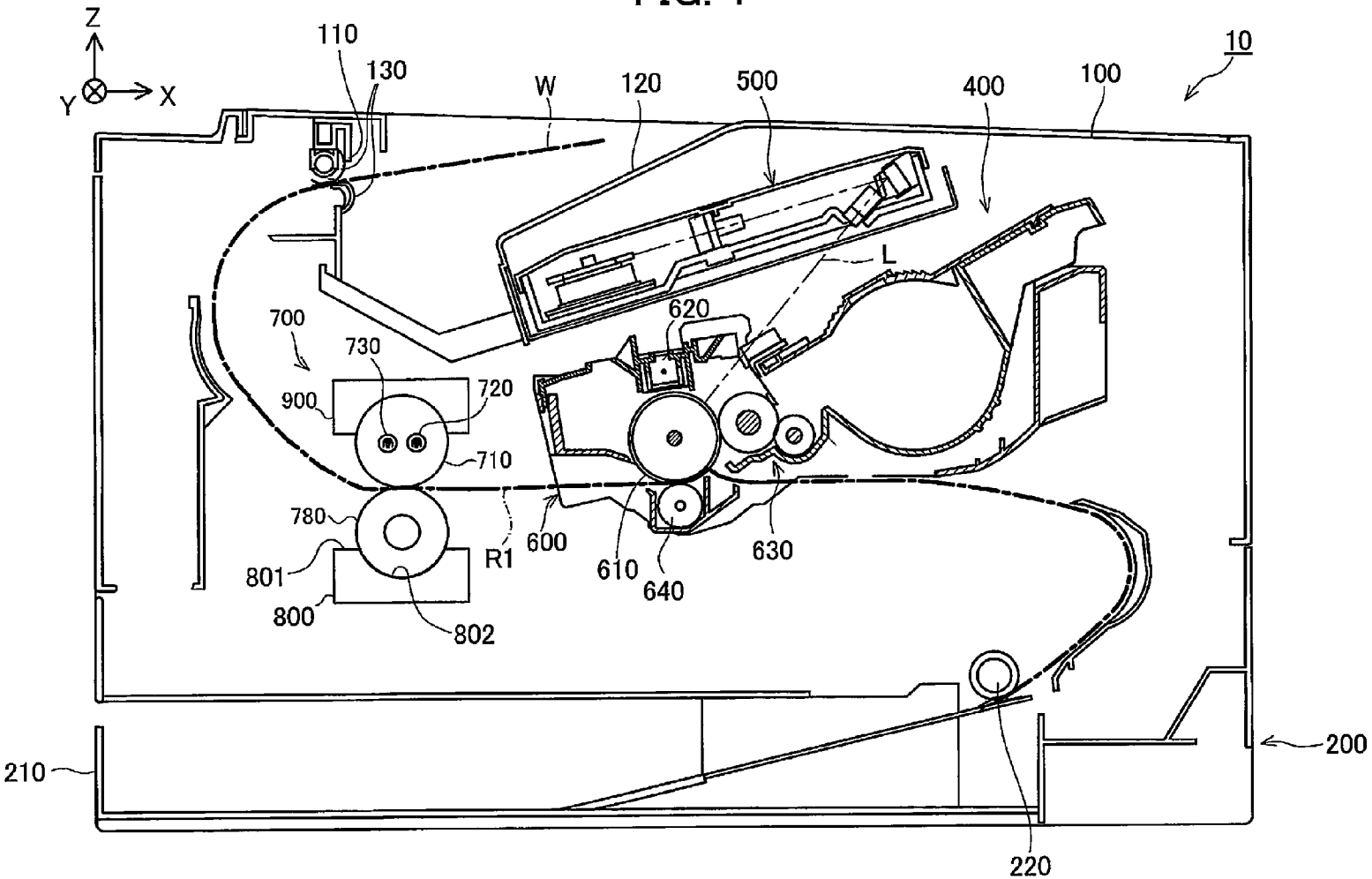
FIG. 1 is a schematic view illustrating a general structure of a printer 10 provided with a fixing device according to one embodiment.

A printer 10 as an example of an image forming apparatus provided with a fixing device according to one embodiment will be described with reference to FIG. 1, wherein like parts and components are designated by the same reference numerals to avoid duplicating description.

In FIG. 1, X, Y, and Z axes perpendicular to each other are illustrated to specify directions. In the following description, for the purpose of convenience, it is assumed that a positive Z-axis direction is defined as an upward direction for specifying an upper side of the printer 10, a negative Z-axis direction is defined as a downward direction to specify a lower side of the printer 10, a positive X-axis direction is defined as a forward direction for specifying a front side of the printer 10, a negative X-axis direction is defined as a rearward direction for specifying a rear side of the printer 10, a positive Y-axis direction is defined as a rightward direction for specifying a right side of the printer 10, and a negative Y-axis direction is defined as a leftward direction for specifying a left side of the printer 10. The same applies to the drawings subsequent to FIG. 1.

The printer 10 is an electrophotographic type printer that forms an image on a sheet W such as a recording sheet or an OHP sheet using a single-color (for example, black) toner (developer). The printer 10 is an example of an image forming apparatus.

As illustrated in FIG. 1, the printer 10 includes a casing 100, a sheet supply section 200, and an image forming section 400. The casing 100 accommodates the sheet supply section 200 and the image forming section 400. A discharge port 110 and a discharge tray 120 are formed on a top surface of the casing 100. Further, a discharge roller 130 is provided in the vicinity of the discharge port 110 in the casing 100. The casing 100 is an example of a main casing.

The sheet supply section 200 includes a tray 210 and a pickup roller 220. The tray 210 is a container that contains sheets W. The pickup roller 220 picks up the sheets W contained in the tray 210 one by one from the tray 210 and conveys the picked-up sheet to the image forming section 400.

The image forming section 400 includes an exposure unit 500, a process unit 600, and a fixing device 700. The exposure unit 500 irradiates a photosensitive body 610 of the process unit 600 with a laser beam L (light beam).

The process unit 600 includes the photosensitive body 610, a charging unit 620, a developing unit 630, and a transfer roller 640. The charging unit 620 uniformly charges a surface of the photosensitive body 610. When the surface of the photosensitive body 610 charged by the charging unit 620 is irradiated with the laser beam L from the exposure unit 500, an electrostatic latent image is formed on the surface of the photosensitive body 610. When the surface of the photosensitive body 610 is supplied with toner by the developing unit 630, the electrostatic latent image formed on the surface of the photosensitive body 610 is developed to form a toner image. The toner image formed on the surface of the photosensitive body 610 is transferred onto a sheet W passing through a position between the photosensitive body 610 and the transfer roller 640 by the transfer roller 640.

The fixing device 700 heats the sheet W passing through the process unit 600 and fixes the toner image transferred onto the sheet W to the sheet W. Accordingly, an image is formed on the sheet W. The detailed configuration of the fixing device 700 will be described later. The discharge roller 130 discharge the sheet W passing through the fixing device 700 to the discharge tray 120 via the discharge port 110. Hereinafter, a conveyance path of a sheet W from the sheet supply section 200 to the discharge roller 130 will be referred to as a conveyance path R1.

Next, the fixing device 700 will be described in detail.

As illustrated in FIG. 1, the fixing device 700 includes a heating roller 710, a first heater 720 and a second heater 730 that are accommodated in the heating roller 710, a top cover 900 that covers a top end portion (downstream end portion in the positive Z-axis direction) of the heating roller 710, a pressure roller 780 that is disposed on the lower side (downstream side in the negative Z-axis direction) of the heating roller 710, and a bottom cover 800 that covers a bottom end portion (downstream end portion in the negative Z-axis direction) of the pressure roller 780.

Figure 2:
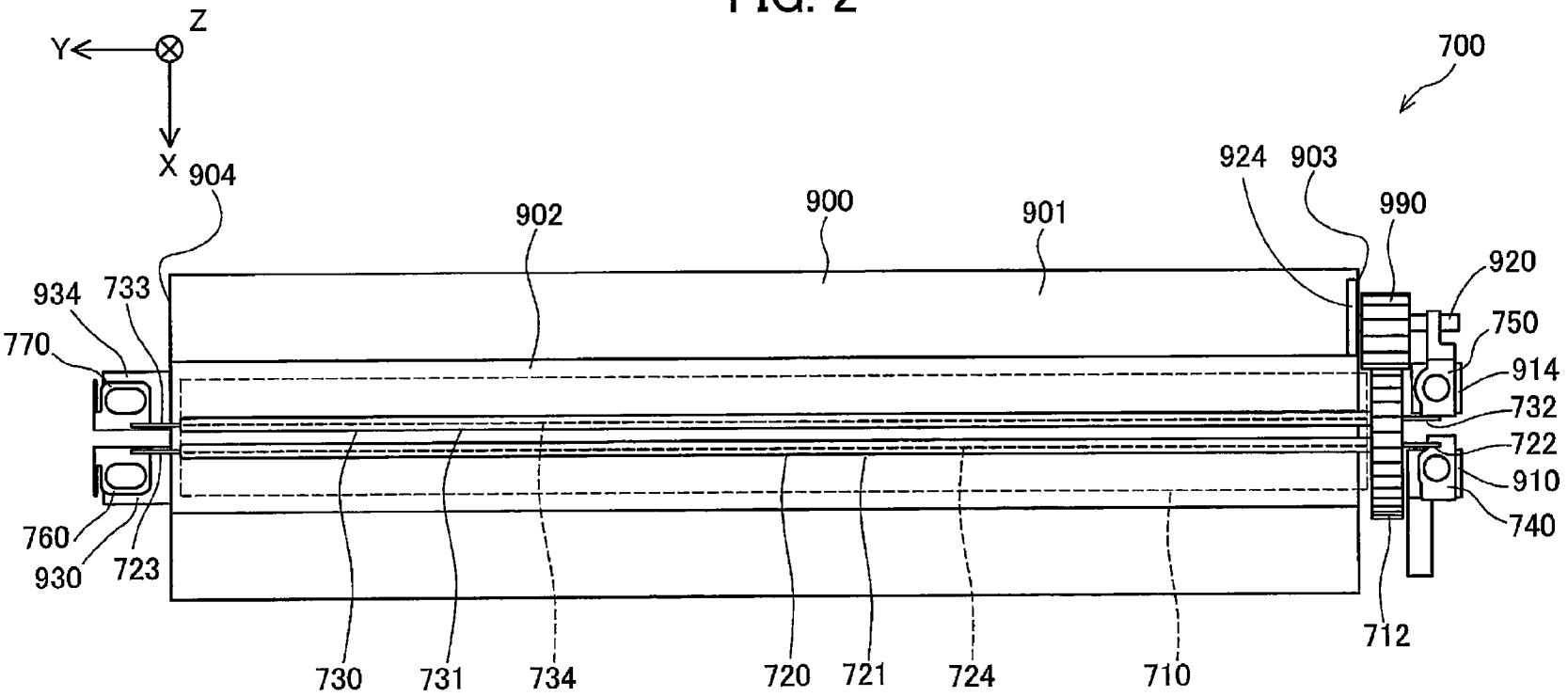
FIG. 2 is a bottom view of a top cover 900, a first heater 720, and a second heater 730 provided at the fixing device according to the embodiment.

As illustrated in FIG. 2, the fixing device 700 further includes a first left terminal member 740 and a second left terminal member 750 that are disposed on the left side (downstream side in the negative Y-axis direction) of the top cover 900, and a first right terminal member 760 and a second right terminal member 770 that are disposed on the right side (downstream side in the positive Y-axis direction) of the top cover 900. The first left terminal member 740 and the first right terminal member 760 are an example of a first terminal member. The first left terminal member 740 and the first right terminal member 760 are also an example of a first terminal. The second left terminal member 750 and the second right terminal member 770 are an example of a second terminal member. The second left terminal member 750 and the second right terminal member 770 are also an example of a second terminal.

Figure 3:
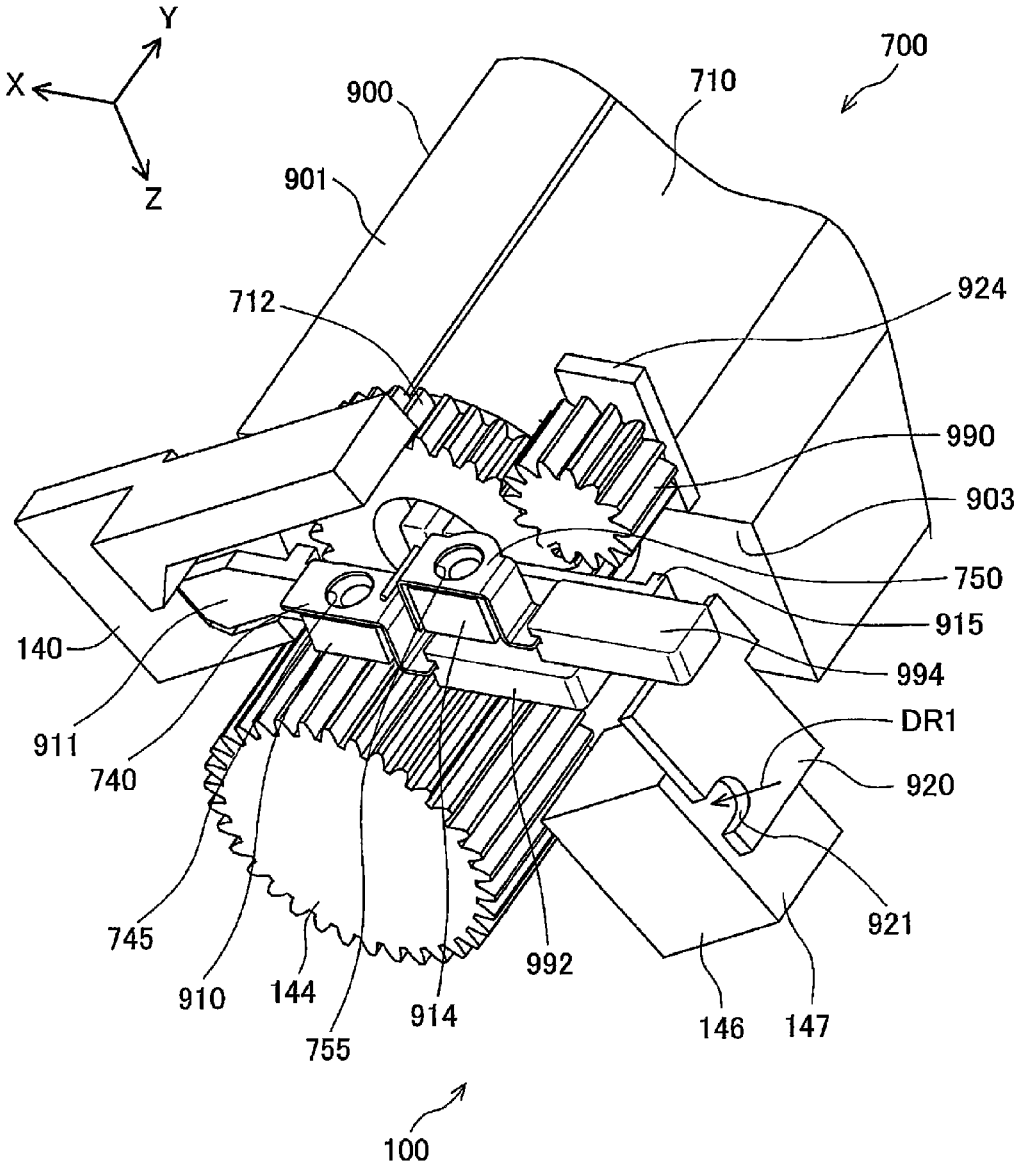
FIG. 3 is a perspective view of a left end portion of the top cover 900, a first left terminal member 740, and a second left terminal member 750 provided at the fixing device according to the embodiment.

As illustrated in FIGS. 2 and 3, the heating roller 710 is a cylindrical member. The heating roller 710 extends in a direction that is aligned in a left-right direction (the Y-axis direction). Note that, in the description, the expression "to be aligned in (a target direction)" means "substantially parallel to the target direction", and more specifically, includes a case in which an angular difference between the actual direction and the target direction is equal to or smaller than 10 degrees as well as a case in which the actual direction is completely parallel to the target direction. The same applies to the expression "to extend in (a target direction)". The heating roller 710 is rotatable about a rotation axis which is substantially parallel to the left-right direction. The heating roller 710 is an example of a tubular member.

A first gear 712 is attached to a left end portion of the heating roller 710. The first gear 712 is disposed on the left side (downstream side in the negative Y-axis direction) relative to a left end face 903 of the top cover 900. The first gear 712 has a cylindrical shape and meshingly engages with a driven gear 990 to be described later. The first gear 712 also meshingly engages with a second gear 144 provided in the casing 100 and receives a driving force from the second gear 144. Upon transmission of the driving force from the second gear 144, the first gear 712 rotates the heating roller 710 and the driven gear 990.

The first heater 720 and the second heater 730 are heating members having an elongated configuration. Specifically, the first heater 720 and the second heater 730 are halogen heaters. The first heater 720 is elongated in a direction that is aligned in the left-right direction (the Y axis direction). The second heater 730 is disposed on the rear side (downstream side in the negative X-axis direction) of the first heater 720 and elongated in a direction that is aligned in the elongated direction of the first heater 720. That is, the first heater 720 and the second heater 730 are arranged in the front-rear direction (the X-axis direction).

As illustrated in FIG. 2, the first heater 720 includes a first glass tube 721, a first heating body 724, a first left lead pin 722, and a first right lead pin 723.

The first glass tube 721 is a cylindrical glass member. The first glass tube 721 is elongated in a direction that is aligned in the left-right direction. The first heating body 724 is disposed on the inner circumferential side of the first glass tube 721 so as to be aligned in the left-right direction (the Y axis direction). The first heating body 724 is, for example, a filament. The first left lead pin 722 protrudes to the left side (downstream side in the negative Y-axis direction) from a left end of the first glass tube 721 and is electrically connected to the first heating body 724. The first right lead pin 723 protrudes to the right side (downstream side in the positive Y-axis direction) from a right end of the first glass tube 721 and is electrically connected to the first heating body 724. The first left lead pin 722 and the first right lead pin 723 are an example of a first lead pin.

The second heater 730 includes a second glass tube 731, a second heating body 734, a second left lead pin 732, and a second right lead pin 733.

The second glass tube 731 is a cylindrical glass member. The second glass tube 731 is elongated in a direction that is aligned in the left-right direction. The second heating body 734 is disposed on the inner circumferential side of the second glass tube 731 so as to be aligned in the left-right direction (the Y axis direction). The second heating body 734 is, for example, a filament. The second left lead pin 732 protrudes to the left side (downstream side in the negative Y-axis direction) from a left end of the second glass tube 731 and is electrically connected to the second heating body 734. The first left lead pin 722 and the second left lead pin 732 are arrayed in the front-rear direction (the X-axis direction) when viewed in the elongated direction of the first heater 720. The second right lead pin 733 protrudes to the right side (downstream side in the positive Y-axis direction) from a right end of the second glass tube 731 and is electrically connected to the second heating body 734. The first right lead pin 723 and the second right lead pin 733 are arrayed in the front-rear direction (the X-axis direction) when viewed in the elongated direction of the first heater 720. The second left lead pin 732 and the second right lead pin 733 are an example of a second lead pin.

As illustrated in FIGS. 1 and 2, the top cover 900 is disposed on the opposite side of the conveyance path R1 with respect to the heating roller 710. The top cover 900 is a columnar member. The top cover 900 is elongated in a direction that is aligned in the left-right direction (the Y-axis direction). An arcuate-shaped groove 902 is formed in a surface 901 of the top cover 900 facing the pressure roller 780. The top end portion of the heating roller 710 is accommodated in the groove 902. The top cover 900 is an example of a frame.

Figure 4:
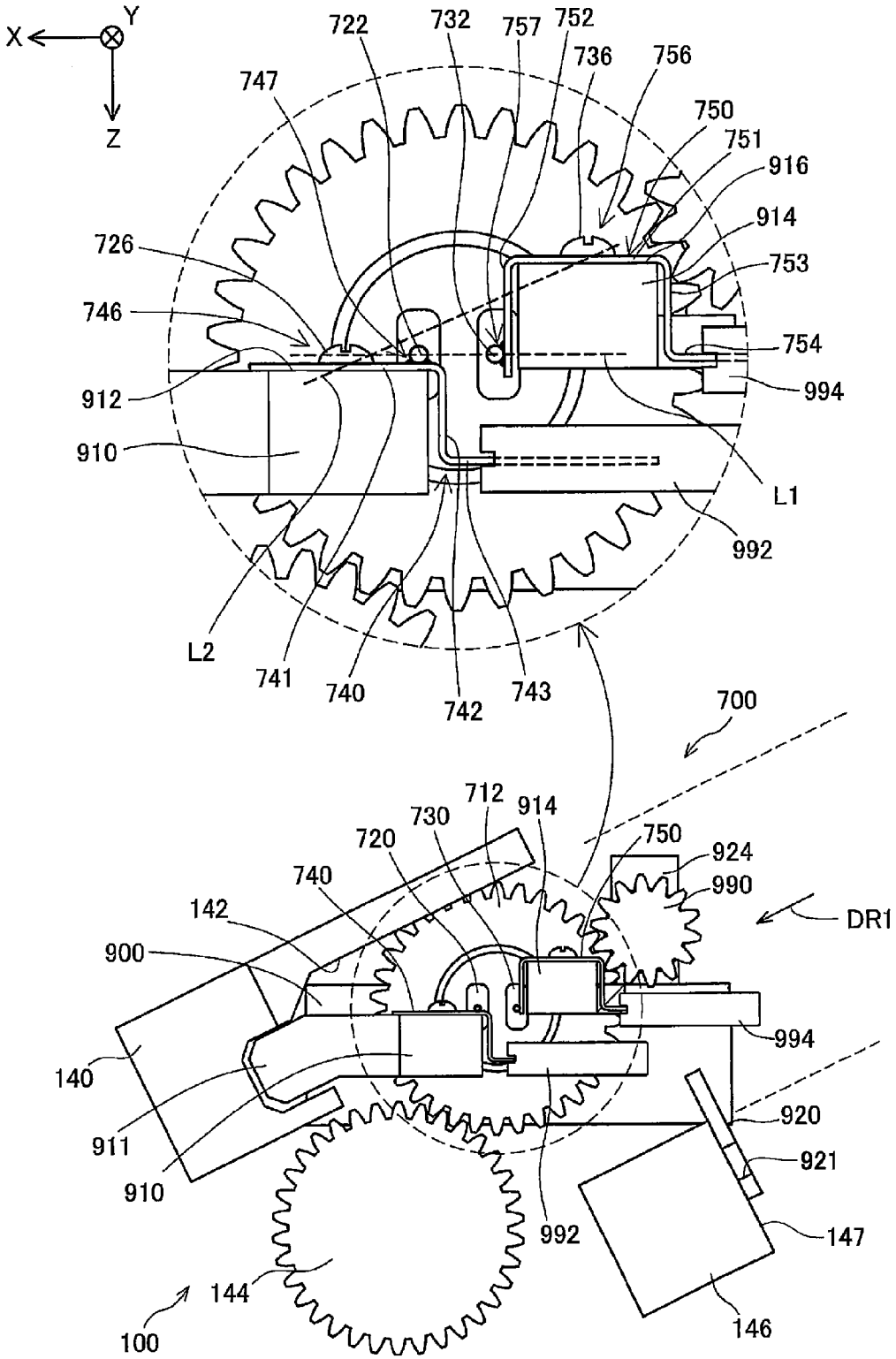
FIG. 4 is a left side view of the top cover 900, the first heater 720, the second heater 730, the first left terminal member 740, the second left terminal member 750 provided at the fixing device according to the embodiment.

As illustrated in FIGS. 2 to 4, the top cover 900 includes a first left fixing portion 910, a second left fixing portion 914, a coupling portion 920, and an attachment portion 924. The first left fixing portion 910, the second left fixing portion 914, and the coupling portion 920 are formed on the left end face 903 of the top cover 900. The first left fixing portion 910 and the second left fixing portion 914 are rectangular parallelepiped members. The first left fixing portion 910 and the second left fixing portion 914 are disposed on the left side (downstream side in the negative Y-axis direction) relative to the first gear 712. The first left fixing portion 910 is disposed on the upper side (downstream side in the positive Z-axis direction) of the first left lead pin 722 and also disposed on the front side (downstream side in the positive X-axis direction) of the second left lead pin 732 when viewed in the elongated direction (the Y-axis direction) of the first heater 720. The first left fixing portion 910 is connected to the left end face 903 of the top cover 900 via a first connecting portion 911. A bottom end surface of the first left fixing portion 910 constitutes a first left fixing surface 912. The second left fixing portion 914 is disposed on the rear side (downstream side in the negative X-axis direction) of the second left lead pin 732 when viewed in the elongated direction of the first heater 720. The second left fixing portion 914 is connected to the left end face 903 of the top cover 900 via a second connection portion 915. A bottom end surface of the second left fixing portion 914 constitutes a second left fixing surface 916. The second left fixing surface 916 of the second left fixing portion 914 extends along the first left fixing surface 912 of the first left fixing portion 910. The first left fixing surface 912 is an example of a first fixing surface, and the second left fixing surface 916 is an example of a second fixing surface.

The first left fixing portion 910 and the second left fixing portion 914 are disposed so as to be separated from each other in the front-rear direction (the X-axis direction) and are also disposed at different positions from each other in an upper-lower direction. Specifically, when viewed in the elongated direction (the Y-axis direction) of the first heater 720, the second left fixing portion 914 is disposed on the diagonally lower-rear side relative to the first left fixing portion 910.

The coupling portion 920 is a plate-shaped member. The coupling portion 920 is disposed on the diagonally upper-rear side relative to the first left lead pin 722 and the second left lead pin 732 when viewed in the elongated direction (the Y-axis direction) of the first heater 720. The coupling portion 920 protrudes to the left side (downstream side in the negative Y-axis direction) from the left end face 903 of the top cover 900. The coupling portion 920 has one surface facing in an attachment direction DR1. The attachment direction DR1 is a moving direction of the fixing device 700 relative to the casing 100 when the fixing device 700 is attached to the casing 100. More specifically, the attachment direction DR1 is a direction sloped diagonally upward and forward. Thus, the one surface of the coupling portion 920 faces in a diagonally upward and forward direction. A notch 921 is formed in the coupling portion 920. The coupling portion 920 is fixed to a coupling surface 147 of a fixing member 146 provided in the casing 100 by a screw extending through the notch 921 in the attachment direction DR1. The coupling surface 147 faces in a direction toward the diagonally lower-rear side of the fixing member 146.

The attachment portion 924 is a plate-shaped member. The attachment portion 924 is disposed on the diagonally lower-rear side relative to the first left lead pin 722 and the second left lead pin 732 when viewed in the elongated direction (the Y-axis direction) of the first heater 720. The attachment portion 924 protrudes to the lower side (downstream side in the negative Z-axis direction) from the surface 901 of the top cover 900. The driven gear 990 is rotatably attached to a left surface of the attachment portion 924.

Figure 5:
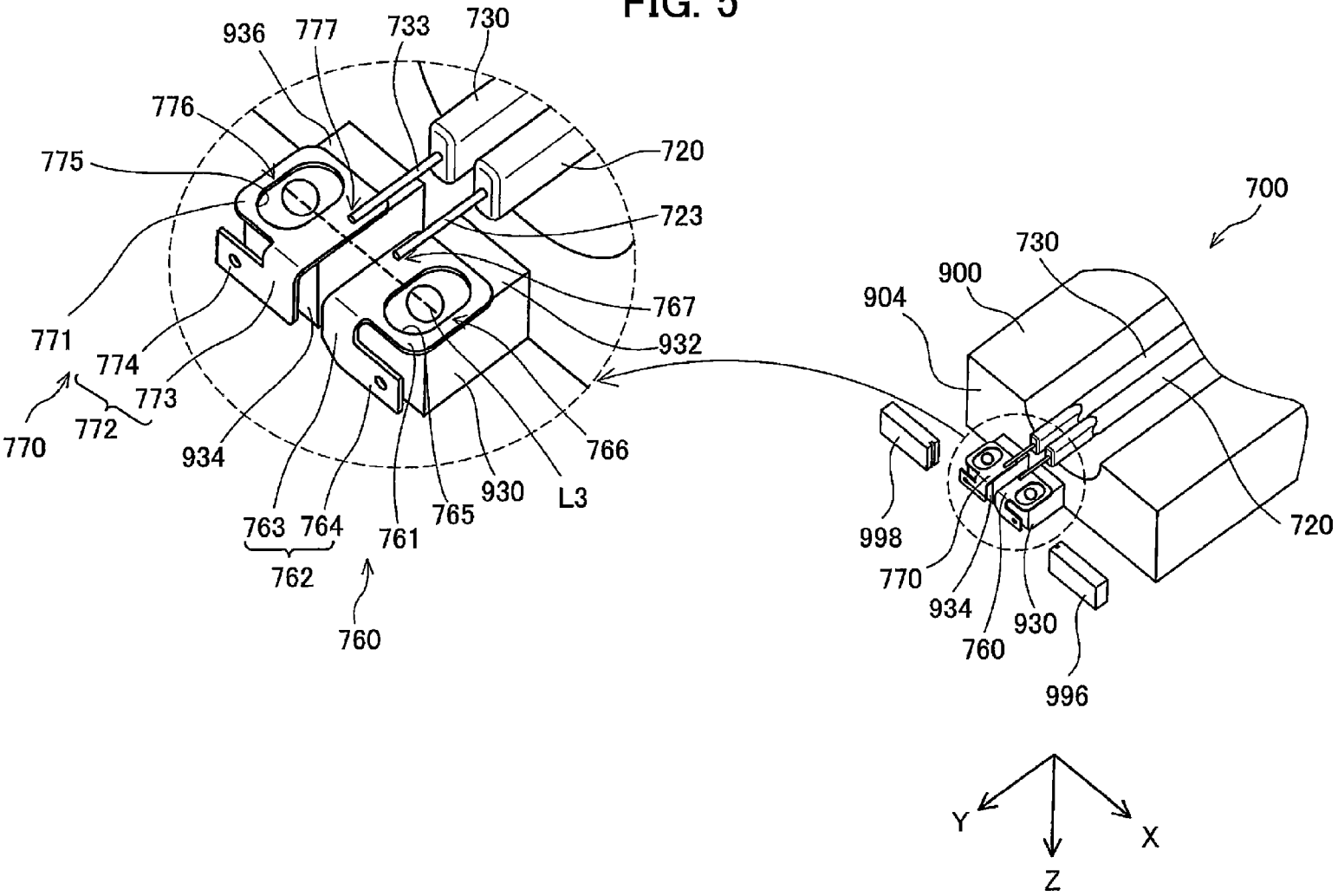
FIG. 5 is a perspective view of a right end portion of the top cover 900, a right end portion of the first heater 720, a right end portion of the second heater 730, a first right terminal member 760, and a second right terminal member 770 provided at the fixing device according to the embodiment, in which a heating roller 710 is omitted.

As illustrated in FIGS. 2 and 5, the top cover 900 further includes a first right fixing portion 930 and a second right fixing portion 934. The first right fixing portion 930 and the second right fixing portion 934 are disposed on a right end face 904 of the top cover 900. The first right fixing portion 930 and the second right fixing portion 934 are rectangular parallelepiped members. The first right fixing portion 930 and the second right fixing portion 934 protrude to the right side (downstream side in the positive Y-axis direction) from the right end face 904 of the top cover 900. The first right fixing portion 930 is disposed on the upper side (downstream side in the positive Z-axis direction) of the first right lead pin 723 and on the front side (downstream side in the positive X-axis direction) of the second right lead pin 733.

A bottom end surface of the first right fixing portion 930 constitutes a first right fixing surface 932. The second right fixing portion 934 is disposed on the upper side of the second right lead pin 733 and on the rear side (downstream side in the negative X-axis direction) of the first right lead pin 723. A bottom end surface of the second right fixing portion 934 constitutes a second right fixing surface 936. The second right fixing surface 936 of the second right fixing portion 934 extends along the first right fixing surface 932 of the first right fixing portion 930. The first right fixing surface 932 is another example of the first fixing surface, and the second right fixing surface 936 is another example of the second fixing surface.

The second right fixing portion 934 is disposed on the rear side (downstream side in the negative X-axis direction) of the first right fixing portion 930. That is, the first right fixing portion 930 and the second right fixing portion 934 are arrayed in the front-rear direction. The first right fixing portion 930 and the second right fixing portion 934 are disposed so as to be separated from each other in the front-rear direction (the X-axis direction).

As illustrated in FIG. 1, the pressure roller 780 is disposed on the opposite side of the heating roller 710 with respect to the conveyance path R1. The pressure roller 780 is disposed so as to contact the heating roller 710. The pressure roller 780 is a cylindrical member. The pressure roller 780 extends in a direction that is aligned in the left-right direction (the Y-axis direction). The pressure roller 780 is rotatable about a rotation axis substantially parallel to the left-right direction. The pressure roller 780 is pressed against the heating roller 710 to provide a nip region formed between the heating roller 710 and the pressure roller 780.

The bottom cover 800 is disposed on the opposite side of the heating roller 710 with respect to the pressure roller 780. The bottom cover 800 is a columnar member. The bottom cover 800 is elongated in a direction that is aligned in the left-right direction (the Y-axis direction). An arcuate-shaped groove 802 is formed in a surface 801 of the bottom cover 800 facing the pressure roller 780. The bottom end portion of the pressure roller 780 is accommodated in the groove 802.

As illustrated in FIGS. 3 and 4, the first left terminal member 740 is a plate-shaped member formed of metal. The first left terminal member 740 is bent into a stepped shape. The first left terminal member 740 has three plate-shaped portions including a first plate-shaped portion 741, a first intermediate portion 742, and a first tip portion 743.

The first plate-shaped portion 741 is disposed so as to be aligned in the front-rear direction (the X-axis direction) when viewed in the elongated direction (the Y-axis direction) of the first heater 720. The first intermediate portion 742 is bent from a rear end of the first plate-shaped portion 741 toward the upper side (downstream side in the positive Z-axis direction) thereof and extends in the upper-lower direction when viewed in the elongated direction (the Y-axis direction) of the first heater 720. The first intermediate portion 742 has one end (lower end) connected to the first plate-shaped portion 741 and the other end (upper end) opposite to the one end of the first intermediate portion 742. The first tip portion 743 is bent from the other end of the first intermediate portion 742 and is oriented in a rearward direction (in the negative X-axis direction) when viewed in the elongated direction (the Y-axis direction) of the first heater 720.

In the description, the expression "to be oriented in (a target direction)" means "to be oriented in a direction substantially equal to the target direction, and more specifically, includes a case in which an angular difference between the actually oriented direction and the target direction is equal to or smaller than 30 degrees as well as a case in which the actually oriented direction is completely equal to the target direction.

The first plate-shaped portion 741 is disposed on the first left fixing surface 912 of the first left fixing portion 910. A through-hole 745 is formed in the first plate-shaped portion 741. The first plate-shaped portion 741 is fixed to the first left fixing surface 912 of the first left fixing portion 910 by a screw 726 extending through the through-hole 745 in a downward direction (the negative Z-axis direction). Hereinafter, a portion at which the first plate-shaped portion 741 is fixed to the first left fixing surface 912 will be referred to as a first fixed portion 746. The "first fixed portion 746" specifically means the center of the through-hole 745 at a top surface of the first plate-shaped portion 741 at which the first plate-shaped portion 741 contacts the first left fixing surface 912 of the first left fixing portion 910. The first plate-shaped portion 741 includes the first fixed portion 746. A direction from the first fixed portion 746 to the first left fixing surface 912 is parallel to the upper-lower direction. Incidentally, FIGS. 2 and 3 illustrates the first left terminal member 740 before being fixed to the first left fixing surface 912 by the screw 726, while FIG. 4 illustrates the first left terminal member 740 after being fixed to the first left fixing surface 912 by the screw 726. The same applies to the second left terminal member 750.

The first left lead pin 722 is welded to the first plate-shaped portion 741, and thus, the first left lead pin 722 and the first left terminal member 740 are electrically connected to each other. The first left lead pin 722 is disposed on the lower side (downstream side in the negative Z-axis direction) of the first plate-shaped portion 741 and is welded to a bottom surface of the first plate-shaped portion 741. Hereinafter, a portion at which the first left lead pin 722 is fixed to the first plate-shaped portion 741 will be referred to as a first connection portion 747.

The first intermediate portion 742 is disposed along a surface on the rear side (downstream side in the negative X-axis direction), i.e. a rear surface, of the first left fixing portion 910. When viewed in the elongated direction (the Y-axis direction) of the first heater 720, the first intermediate portion 742 is disposed between the first left lead pin 722 and the second left lead pin 732 in the front-rear direction (the X-axis direction) and also between the first left fixing portion 910 and the second left fixing portion 914 in the front-rear direction (the X-axis direction).

The first tip portion 743 extends along the first plate-shaped portion 741 and is disposed on the rear side (downstream side in the negative X-axis direction) of the first left fixing portion 910. As indicated by a dashed line in FIG. 4, the first tip portion 743 engages with a first connector 992 provided at the fixing device 700. Accordingly, the first tip portion 743 is electrically connected to a power source (not illustrated) via the first connector 992, and the first heater 720 is supplied with electric power through the first connector 992. The first intermediate portion 742 and the first tip portion 743 are an example of a second electrical connection portion. The first intermediate portion 742 is an example of a second intermediate portion. The first tip portion 743 is an example of a second tip portion.

The second left terminal member 750 is a plate-shaped member formed of metal. The second left terminal member 750 is bent into a key shape. The second left terminal member 750 has four plate-shaped portions including a second plate-shaped portion 751, a third plate-shaped portion 752, a second intermediate portion 753, and a second tip portion 754.

The second plate-shaped portion 751 is disposed so as to be aligned in the front-rear direction (the X-axis direction) when viewed in the elongated direction (the Y-axis direction) of the first heater 720. The third plate-shaped portion 752 is bent from a front end of the second plate-shaped portion 751 toward the upper side (downstream side in the positive Z-axis direction) thereof and extends in the upper-lower direction when viewed in the elongated direction (the Y-axis direction) of the first heater 720. The second intermediate portion 753 is bent from a rear end of the second plate-shaped portion 751 toward the upper side (downstream side in the positive Z-axis direction) thereof and extends in the upper-lower direction when viewed in the elongated direction (the Y-axis direction) of the first heater 720. The second intermediate portion 753 has one end (lower end) connected to the second plate-shaped portion 751 and the other end (upper end) opposite to the one end of the second intermediate portion 753. The second tip portion 754 is bent from the other end of the second intermediate portion 753 and is oriented in the rearward direction (in the negative X-axis direction) when viewed in the elongated direction (the Y-axis direction) of the first heater 720.

The second plate-shaped portion 751 is disposed on the second left fixing surface 916 of the second left fixing portion 914. The second plate-shaped portion 751 is disposed along the first plate-shaped portion 741. A through-hole 755 is formed in the second plate-shaped portion 751. The second plate-shaped portion 751 is fixed to the second left fixing surface 916 of the second left fixing portion 914 by a screw 736 extending through the through-hole 755 in the downward direction (the negative Z-axis direction). Hereinafter, a portion at which the second plate-shaped portion 751 is fixed to the second left fixing surface 916 will be referred to as a second fixed portion 756. The "second fixed portion 756" specifically means the center of the through-hole 755 at a top surface of the second plate-shaped portion 751 at which the second plate-shaped portion 751 contacts the second left fixing surface 916 of the second left fixing portion 914. The second plate-shaped portion 751 includes the second fixed portion 756. A direction from the second fixed portion 756 to the second left fixing surface 916 is parallel to the upper-lower direction.

As illustrated in FIG. 4, the second fixed portion 756 is disposed at a position different from the first fixed portion 746 in the front-rear direction (the X-axis direction) and in the upper-lower direction (the Z-axis direction). Specifically, when viewed in the elongated direction (the Y-axis direction) of the first heater 720, the second left fixing portion 914 is disposed on the diagonally lower-rear side relative to the first left fixing portion 910. That is, a first array direction of fixed portions (L2) in which the first fixed portion 746 and the second fixed portion 756 are arrayed is inclined relative to the front-rear direction (L1). Here, the "first array direction of fixed portions (L2)" specifically means a direction connecting the center of the through-hole 745 of the first left terminal member 740 and the center of the through-hole 755 of the second left terminal member 750 when viewed in the elongated direction of the first heater 720. The "first array direction of fixed portions (L2)" also means a direction connecting the center of the first left fixing surface 912 of the first left fixing portion 910 and the center of the second left fixing surface 916 of the second left fixing portion 914 when viewed in the elongated direction of the first heater 720. Incidentally, the angular difference between the first array direction of fixed portions (L2) and the front-rear direction (L1) is equal to or smaller than 30 degrees, and therefore, "to be oriented in a direction from the first fixed portion 746 to the second fixed portion 756" is substantially equal to "to be oriented in a rearward direction (the negative X-axis direction)". The first array direction of fixed portions is an example of an array direction.

The second fixed portion 756 is disposed at a position overlapping at least a part of the first tip portion 743 of the first left terminal member 740 when viewed in the upper-lower direction. In the upper-lower direction, the second fixed portion 756 is disposed on the opposite side of the first tip portion 743 with respect to the second left fixing surface 916.

The third plate-shaped portion 752 is disposed along a surface on the front side (downstream side in the positive X-axis direction), i.e. a front surface, of the second left fixing portion 914. The third plate-shaped portion 752 is also disposed on the rear side (downstream side in the negative X-axis direction) of the second left lead pin 732. The second left lead pin 732 is welded to the third plate-shaped portion 752, and thus, the second left lead pin 732 and the second left terminal member 750 are electrically connected to each other. The second left lead pin 732 is disposed on the front side of the third plate-shaped portion 752 and is welded to a front surface of the third plate-shaped portion 752. That is, the second left lead pin 732 is disposed on the same side as the first left lead pin 722 with respect to the third plate-shaped portion 752. Hereinafter, a portion at which the second left lead pin 732 is fixed to the second plate-shaped portion 751 will be referred to as a second connection portion 757.

The second intermediate portion 753 is disposed along a surface on the rear side (downstream side in the negative X-axis direction), i.e. a rear surface, of the second left fixing portion 914. The second intermediate portion 753 is disposed on the opposite side of the second left lead pin 732 with respect to the second left fixing portion 914 in the front-rear direction (the X-axis direction) when viewed in the elongated direction (the Y-axis direction) of the first heater 720.

The second tip portion 754 extends along the first plate-shaped portion 741 of the first left terminal member 740. The second tip portion 754 is disposed on the rear side (downstream side in the negative X-axis direction) of the second left fixing portion 914. The second tip portion 754 engages with a second connector 994 provided at the fixing device 700, as indicated by a dashed line in FIG. 4. Accordingly, the second tip portion 754 is electrically connected to the power source (not illustrated) via the second connector 994, and the second heater 730 is supplied with electric power through the second connector 994. The second intermediate portion 753 and the second tip portion 754 are an example of a first electrical connection portion. The second intermediate portion 753 is an example of a first intermediate portion. The second tip portion 754 is an example of a first tip portion.

As illustrated in FIGS. 2 and 5, the first right terminal member 760 is a plate-shaped member formed of metal. The first right terminal member 760 is bent into an L-shape. The first right terminal member 760 has two plate-shaped portions including a third plate-shaped portion 761 and a fourth plate-shaped portion 762.

The third plate-shaped portion 761 is disposed so as to be aligned in the front-rear direction (the X-axis direction). The fourth plate-shaped portion 762 is bent from a right end of the third plate-shaped portion 761 toward the upper side (downstream side in the positive Z-axis direction) thereof and extends in the upper-lower direction. The third plate-shaped portion 761 is another example of the first plate-shaped portion, and the fourth plate-shaped portion 762 is another example of the second electrical connection portion.

The third plate-shaped portion 761 is disposed on the first right fixing surface 932 of the first right fixing portion 930. A through-hole 765 is formed in the third plate-shaped portion 761. The third plate-shaped portion 761 is fixed to the first right fixing surface 932 of the first right fixing surface 932 by a screw (not illustrated) extending through the through-hole 765 in a downward direction (the negative Z-axis direction). Hereinafter, a portion at which the third plate-shaped portion 761 is fixed to the first right fixing surface 932 will be referred to as a third fixed portion 766. The "third fixed portion 766" specifically means the center of the through-hole 765 at a top surface of the third plate-shaped portion 761 at which the third plate-shaped portion 761 contacts the first right fixing surface 932 of the first right fixing portion 930. The third plate-shaped portion 761 includes the third fixed portion 766. A direction from the third fixed portion 766 to the first right fixing surface 932 is parallel to the upper-lower direction. In FIG. 5, the first right terminal member 760 before being fixed to the first right fixing surface 932 by the screw is illustrated. The same applies to the second right terminal member 770. The third fixed portion 766 is another example of the first fixed portion.

The first right lead pin 723 is welded to the third plate-shaped portion 761, and thus, the first right lead pin 723 and the first right terminal member 760 are electrically connected to each other. The first right lead pin 723 is disposed on the lower side (downstream side in the negative Z-axis direction) of the third plate-shaped portion 761 and is welded to a bottom surface of the third plate-shaped portion 761. Hereinafter, a portion at which the first right lead pin 723 is fixed to the third plate-shaped portion 761 will be referred to as a third connection portion 767.

The fourth plate-shaped portion 762 is bent from a right end of the third plate-shaped portion 761 toward the upper side (downstream side in the positive Z-axis direction) thereof. The right end of the third plate-shaped portion 761 is an end of the third plate-shaped portion 761 separated farthest from the first heater 720 in the elongated direction (the Y-axis direction) of the first heater 720. The fourth plate-shaped portion 762 is disposed along a surface on the right side (downstream side in the positive Y-axis direction), i.e. a right surface, of the first right fixing portion 930. The fourth plate-shaped portion 762 is a plate-shaped member having an L-shape when viewed in the elongated direction (the Y-axis direction) of the first heater 720.

The fourth plate-shaped portion 762 includes a third intermediate portion 763 and a third tip portion 764.

The third intermediate portion 763 is bent from the right end of the third plate-shaped portion 761 toward the upper side (downstream side in the positive Z-axis direction) thereof and extends in the upper-lower direction. The third intermediate portion 763 has one end connected to the third plate-shaped portion 761 and the other end opposite to the one end of the third intermediate portion 763. The third tip portion 764 extends in the front-rear direction (the X-axis direction) from the other end of the third intermediate portion 763. The third intermediate portion 763 is another example of the second intermediate portion, and the third tip portion 764 is another example of the second tip portion.

The third tip portion 764 is oriented in a forward direction (the positive X-axis direction). The third tip portion 764 engages with a third connector 996. The third connector 996 is provided at the fixing device 700 and disposed on the front side relative to the third tip portion 764. Accordingly, the third tip portion 764 is electrically connected to the power source (not illustrated) via the third connector 996, and the first heater 720 is supplied with electric power through the third connector 996. The fourth plate-shaped portion 762 including the third intermediate portion 763 and the third tip portion 764 is another example of the second electrical connection portion, and the third connector 996 is another example of the first connector.

As illustrated in FIGS. 2 and 5, the second right terminal member 770 is a plate-shaped member formed of metal. The second right terminal member 770 is bent into an L-shape. The second right terminal member 770 has two plate-shaped portions including a fifth plate-shaped portion 771 and a sixth plate-shaped portion 772.

The fifth plate-shaped portion 771 is disposed so as to be aligned in the front-rear direction (the X-axis direction). The sixth plate-shaped portion 772 is bent from a right end of the fifth plate-shaped portion 771 toward the upper side (downstream side in the positive Z-axis direction) thereof and extends in the upper-lower direction. The fifth plate-shaped portion 771 is another example of the second plate-shaped portion, and the sixth plate-shaped portion 772 is another example of the first electrical connection portion.

The fifth plate-shaped portion 771 is disposed on the second right fixing surface 936 of the second right fixing portion 934. The fifth plate-shaped portion 771 is disposed along the third plate-shaped portion 761. The fifth plate-shaped portion 771 extends in the front-rear direction (the X-axis direction). The third tip portion 764 of the first right terminal member 760 extends in the front-rear direction, and therefore, extends along the fifth plate-shaped portion 771. A through-hole 775 is formed in the fifth plate-shaped portion 771. The fifth plate-shaped portion 771 is fixed to the second right fixing surface 936 of the second right fixing portion 934 by a screw (not illustrated) extending through the through-hole 775 in the downward direction (the negative Z-axis direction). Hereinafter, a portion at which the fifth plate-shaped portion 771 is fixed to the second right fixing surface 936 will be referred to as a fourth fixed portion 776. The "fourth fixed portion 776" specifically means the center of the through-hole 775 at a top surface of the fifth plate-shaped portion 771 at which the fifth plate-shaped portion 771 contacts the second right fixing surface 936 of the second right fixing portion 934. The fifth plate-shaped portion 771 includes the fourth fixed portion 776. A direction from the fourth fixed portion 776 to the second right fixing surface 936 is parallel to the upper-lower direction. The fourth fixed portion 776 is another example of the second fixed portion.

The fourth fixed portion 776 is disposed on the rear side of the third fixed portion 766. The third fixed portion 766 and the fourth fixed portion 776 are arrayed in the front-rear direction (the X-axis direction). That is, in a second array direction of fixed portions (L3) in which the third fixed portion 766 and the fourth fixed portion 776 are arrayed is parallel to the front-rear direction (L1). Here, the "second array direction of fixed portions (L3)" specifically means a direction connecting the center of the through-hole 765 of the first right terminal member 760 and the center of the through-hole 775 of the second right terminal member 770 when viewed in the elongated direction of the first heater 720. The "second array direction of fixed portions (L3)" also means a direction connecting the center of the first right fixing surface 932 of the first right fixing portion 930 and the center of the second right fixing surface 936 of the second right fixing portion 934 when viewed in the elongated direction of the first heater 720. The second array direction of fixed portions is another example of the array direction.

The second right lead pin 733 is welded to the fifth plate-shaped portion 771, and thus, the second right lead pin 733 and the second right terminal member 770 are electrically connected to each other. The second right lead pin 733 is disposed on the lower side (downstream side in the negative Z-axis direction) of the fifth plate-shaped portion 771 and is welded to a lower surface of the fifth plate-shaped portion 771. Hereinafter, a portion at which the second right lead pin 733 is fixed to the fifth plate-shaped portion 771 will be referred to as a fourth connection portion 777.

The sixth plate-shaped portion 772 is bent from a right end of the fifth plate-shaped portion 771 toward the upper side (downstream side in the positive Z-axis direction) thereof. The right end of the fifth plate-shaped portion 771 is an end of the fifth plate-shaped portion 771 separated farthest from the second heater 730 in the elongated direction (the Y-axis direction) of the first heater 720. The sixth plate-shaped portion 772 is disposed along a surface on the right side (downstream side in the positive Y-axis direction), i.e. a right surface, of the second right fixing portion 934. The sixth plate-shaped portion 772 is a plate-shaped member having an L-shape when viewed in the elongated direction (the Y-axis direction) of the first heater 720.

The sixth plate-shaped portion 772 includes a fourth intermediate portion 773 and a fourth tip portion 774.

The fourth intermediate portion 773 is bent from the right end of the fifth plate-shaped portion 771 toward the upper side (downstream side in the positive Z-axis direction) thereof and extends in the upper-lower direction. The fourth intermediate portion 773 has one end connected to the fifth plate-shaped portion 771 and the other end opposite to the one end of the fourth intermediate portion 773. The fourth tip portion 774 extends in the front-rear direction (the X-axis direction) from the other end of the fourth intermediate portion 773. The fourth intermediate portion 773 is another example of the first intermediate portion, and the fourth tip portion 774 is another example of the first tip portion.

The fourth tip portion 774 is oriented in a rearward direction (the negative X-axis direction). The fourth tip portion 774 extends along the third plate-shaped portion 761. The fourth tip portion 774 extends from the fourth intermediate portion 773 in a direction opposite to a direction in which the third tip portion 764 extends from the third intermediate portion 763 such that a distance from a base end of the fourth tip portion 774 to a base end of the third intermediate portion 763 is smaller than a distance from a free end of the fourth tip portion 774 to a free end of the third tip portion 764 with respect to the front-rear direction (X-axis direction). The fourth tip portion 774 engages with a fourth connector 998. The fourth connector 998 is provided at the fixing device 700 and disposed on the rear side relative to the fourth tip portion 774. Accordingly, the fourth tip portion 774 is electrically connected to the power source (not illustrated) via the fourth connector 998, and the second heater 730 is supplied with electric power through the fourth connector 998. The fourth connector 998 is disposed so as to overlap at least a part of the third connector 996 when viewed in the front-rear direction (the X-axis direction). The sixth plate-shaped portion 772 including the fourth intermediate portion 773 and the fourth tip portion 774 is another example of the first electrical connection portion, and the fourth connector 998 is another example of the second connector.

A direction connecting the second fixed portion 756 and the second fixing surface 916 is an example of a first direction. A direction connecting the fourth fixed portion 776 and the second right fixing surface 936 is another example of the first direction. A direction from the first fixed portion 746 to the second fixed portion 756 is an example of a second direction. A direction from the third fixed portion 766 to the fourth fixed portion 776 is another example of the second direction. A direction from the first fixed portion 746 to the first fixing surface 912 is an example of a third direction.

The fixing device 700 is detachably attached to the casing 100. As illustrated in FIG. 4, the fixing device 700 is moved relative to the casing 100 in the attachment direction DR1 to be attached to the casing 100. Specifically, at the time of attachment to the casing 100, the fixing device 700 is moved in the attachment direction DR1 relative to the casing 100, and a front end portion of the first connecting portion 911 comes into contact with a positioning member 140 provided in the casing 100. The first connecting portion 911 is further moved along an inclined surface 142 of the positioning member 140 to fix the fixing device 700 in position relative to the casing 100. Accordingly, the first gear 712 meshingly engages with the second gear 144 disposed on the downstream side (front side) relative to the first gear 712 in the attachment direction DR1. By fixing the coupling portion 920 to the fixing member 146 with a screw or the like, the fixing device 700 is fixed to the casing 100.

In a state where the fixing device 700 is fixed to the casing 100, the first left terminal member 740 is disposed closer to the second gear 144 than the second left terminal member 750 to the second gear 144. As described above, the first tip portion 743 of the first left terminal member 740 is bent from the other end of the first intermediate portion 742 opposite to the one end of the first intermediate portion 742 connected to the first plate-shaped portion 741 and is oriented in the rearward direction (the negative X-axis direction). Accordingly, with respect to the attachment direction DR1, the first tip portion 743 of the first left terminal member 740 is oriented in a direction opposite to the attachment direction DR1. The first tip portion 743 is disposed at a position not overlapping the fixing member 146 in the attachment direction DR1.

In the present embodiment, the second tip portion 754 of the second left terminal member 750 extends along the first plate-shaped portion 741 of the first left terminal member 740. Accordingly, in comparison with a case in which the second tip portion 754 extends in a direction perpendicular to the first plate-shaped portion 741, a space to be secured around the first plate-shaped portion 741 for disposing the second tip portion 754 can be reduced. Hence, a space around the first left terminal member 740 and the second left terminal member 750 and positioned leftward of the left end face 903 of the top cover 900 can be saved.

Specifically, the second tip portion 754 is oriented in the rearward direction (in the negative X-axis direction) that is one of the directions aligned with the first plate-shaped portion 741. That is, the second tip portion 754 is oriented in a direction from the first fixed portion 746 to the second fixed portion 756. Accordingly, in comparison with a case in which the second tip portion 754 is oriented, for example, in one of the leftward direction (the negative Y-axis direction) and the rightward direction (the positive Y-axis direction), the dimension in the left-right direction of the fixing device 700 can be reduced since the second connector 994 can be disposed so as to be aligned in the front-rear direction (the X-axis direction).

Similarly, in the present embodiment, the fourth tip portion 774 of the second right terminal member 770 extends along the third plate-shaped portion 761 of the first right terminal member 760. Accordingly, in comparison with a case in which the fourth tip portion 774 extends in a direction perpendicular to the third plate-shaped portion 761, a space to be secured around the third plate-shaped portion 761 for disposing the fourth tip portion 774 can be reduced. Hence, a space around the first right terminal member 760 and the second right terminal member 770 and positioned rightward of the right end face 904 of the top cover 900 can be saved.

Specifically, the fourth tip portion 774 is oriented in the rearward direction (in the negative X-axis direction) that is one of the directions aligned with the third plate-shaped portion 761. That is, the fourth tip portion 774 is oriented in a direction from the third fixed portion 766 to the fourth fixed portion 776. Accordingly, in comparison with a case in which the fourth tip portion 774 is oriented, for example, in one of the leftward direction (the negative Y-axis direction) and the rightward direction (the positive Y-axis direction), the dimension in the left-right direction of the fixing device 700 can be reduced since the fourth connector 998 can be disposed so as to be aligned in the front-rear direction.

In the present embodiment, at a position leftward of the left end face 903 of the top cover 900, the first tip portion 743 of the first left terminal member 740 is disposed closer to the second gear 144 than the second left terminal member 750 to the second gear 144. Further, the first tip portion 743 of the first left terminal member 740 is disposed on the rear side (downstream side in the negative X-axis direction) of the first left fixing portion 910. Further, the first tip portion 743 of the first left terminal member 740 is oriented in the rearward direction. That is, the first tip portion 743 of the first left terminal member 740 is oriented in a direction opposite to the attachment direction DR1 of the fixing device 700. Accordingly, in comparison with a case in which the first tip portion 743 of the first left terminal member 740 is oriented in the attachment direction DR1 of the fixing device 700, the first tip portion 743 of the first left terminal member 740 can be prevented from interfering with other members provided in the printer 10 such as the fixing member 146 when the fixing device 700 is attached to the printer 10. Therefore, the fixing device 700 can be easily attached to the printer 10.

In the present embodiment, the first tip portion 743 is disposed at a position not overlapping the fixing member 146 in the attachment direction DR1. Accordingly, the first tip portion 743 can be prevented from interfering with the fixing member 146, enabling the fixing device 700 to be easily attached to the printer 10.

In the present embodiment, in order to realize the above-described configuration, the second left fixing portion 914 is disposed at a position offset to the lower side (downstream side in the negative Z-axis direction) from the first left fixing portion 910 in the upper-lower direction, and the first tip portion 743 of the first left terminal member 740 is disposed in the space on the upper side (downstream side in the positive Z-axis direction) of the second left fixing portion 914 formed by this arrangement. That is, the first tip portion 743 is disposed on the opposite side of the second fixed portion 756 with respect to the second left fixing surface 916 in the upper-lower direction. Accordingly, in comparison with a case in which the first tip portion 743 is disposed on the same side as the second fixed portion 756 with respect to the second left fixing surface 916, a space can be secured for a fixing operation for fixing the second fixed portion 756 to the second left fixing surface 916. Further, when viewed in the elongated direction of the first heater 720, the first left fixing portion 910, the second left fixing portion 914, and the first tip portion 743 can be positioned closely to one another in the upper-lower direction.

In the present embodiment, the first left terminal member 740 is provided with the first intermediate portion 742 that is bent from the rear end of the first plate-shaped portion 741 toward the upper side (downstream side in the positive Z-axis direction) thereof and extends in the upper-lower direction. The first tip portion 743 is connected to the first plate-shaped portion 741 via the first intermediate portion 742. Accordingly, in comparison with a case in which the first tip portion 743 is directly connected to the first plate-shaped portion 741, a distance in the upper-lower direction between the second left fixing portion 914 and the first left fixing portion 910 can be reduced. In other words, in comparison with a case in which the first tip portion 743 is directly connected to the first plate-shaped portion 741, a distance by which the second left fixing base 914 is moved to the lower side (downstream side in the negative Z-axis direction) relative to the first left fixing base 910 can be reduced. Hence, while interference of the first tip portion 743 with the second left terminal member 750 can be prevented, the distance between the first plate-shaped portion 741 and the second left terminal member 750 can be decreased.

In the present embodiment, when viewed in the upper-lower direction, at least a part of the first tip portion 743 overlaps the second fixed portion 756. Accordingly, in comparison with a case in which no portion of the first tip portion 743 overlaps the second fixed portion 756, the distance between the first left terminal member 740 and the second left terminal member 750 can be decreased. Accordingly, as illustrated in FIG. 4, when viewed in the elongated direction of the first heater 720, the first left terminal member 740 and the second left terminal member 750 except for the second tip portion 754 can be disposed within an addendum circle of the first gear 712.

In the present embodiment, at a position rightward of the right end face 904 of the top cover 900, the third tip portion 764 of the first right terminal member 760 is oriented in the forward direction (in the positive X-axis direction), while the fourth tip portion 774 of the second right terminal member 770 is oriented in the rearward direction (in the negative X-axis direction). That is, the third tip portion 764 and the fourth tip portion 774 are oriented in opposite directions from each other such that a distance from the free end of the third tip portion 764 to the free end of the fourth tip portion 774 is greater than a distance from the base end of the third tip portion 764 to the base end of the fourth tip portion 774 in the front-rear direction. Accordingly, in comparison with a case in which the third tip portion 764 and the fourth tip portion 774 are oriented substantially in the same direction with respect to the front-rear direction, such as a case in which the third tip portion 764 and the fourth tip portion 774 are both oriented in the rearward direction or a case in which the third tip portion 764 and the fourth tip portion 774 are both oriented in the forward direction, the distance between the free end of the third tip portion 764 and the free end of the fourth tip portion 774 can be increased.

In the present embodiment, at a position rightward of the right end face 904 of the top cover 900, the fourth connector 998 is disposed so as to overlap at least a part of the third connector 996 when viewed in the front-rear direction (the X-axis direction). Accordingly, in comparison with a case in which the fourth connector 998 is disposed such that no portion of the fourth connector 998 overlaps the third connector 996, a space for disposing the fourth connector 998 and the third connector 996 can be reduced in the left-right direction (the Y-axis direction) and the upper-lower direction (X-axis direction). Hence, the dimension of the fixing device 700 in the left-right direction and the upper-lower direction can be reduced.

Various modifications to the above-described embodiment are conceivable.

A fixing device 700A according to one modification to the above-described embodiment will be described while referring to FIG. 6, wherein like parts and components are designated by the same reference numerals as those of the above-described embodiment to avoid duplicating description.

In the above-described embodiment, the fourth plate-shaped portion 762 of the first right terminal member 760 is bent from the third plate-shaped portion 761 toward the upper side (downstream side in the positive Z-axis direction) thereof, and the sixth plate-shaped portion 772 of the second right terminal member 770 is bent from the fifth plate-shaped portion 771 toward the upper side (downstream side in the positive Z-axis direction) thereof. However, with respect to the upper-lower direction, the directions in which the fourth plate-shaped portion 762 and the sixth plate-shaped portion 772 are bent may be different from each other.

Figure 6:
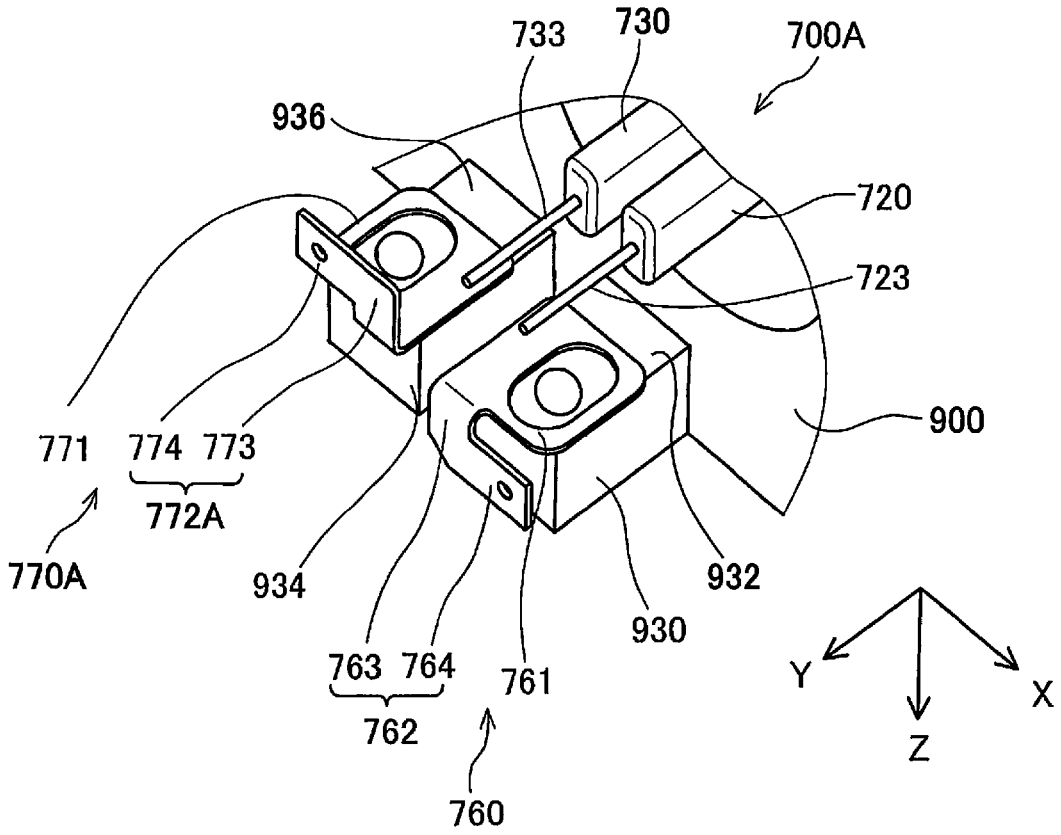
FIG. 6 is a perspective view of the right end portion of the top cover 900, the right end portion of the first heater 720, the right end portion of the second heater 730, the first right terminal member 760, and a second right terminal member 770A provided at a fixing device 700A according to a modification to the embodiment.

As illustrated in FIG. 6, the fixing device 700A includes the first right terminal member 760 and a second right terminal member 770A. The fourth plate-shaped portion 762 of the first right terminal member 760 is bent from the third plate-shaped portion 761 toward the upper side (downstream side in the positive Z-axis direction) thereof and extends in the upper-lower direction. However, a sixth plate-shaped portion 772A of the second right terminal member 770A is bent from the fifth plate-shaped portion 771 toward the lower side (downstream side in the negative Z-axis direction) thereof and extends in the upper-lower direction. That is, the direction (i.e. upward direction) in which the fourth plate-shaped portion 762 is bent and extends from the third plate-shaped portion 761 is opposite to the direction (i.e. downward direction) in which the sixth plate-shaped portion 772A is bent and extends from the fifth plate-shaped portion 771. In other words, the fourth plate-shaped portion 762 and the sixth plate-shaped portion 772A are bent in opposite directions of each other with respect to the third plate-shaped portion 761 and the fifth plate-shaped portion 771 from which the fourth plate-shaped portion 762 and the sixth plate-shaped portion 772A are bent. Accordingly, in comparison with a case in which the direction in which the fourth plate-shaped portion 762 is bent and extends from the third plate-shaped portion 761 is the same as the direction in which the sixth plate-shaped portion 772A is bent and extends from the fifth plate-shaped portion 771, the distance between the third tip portion 764 of the fourth plate-shaped portion 762 and the fourth tip portion 774 of the sixth plate-shaped portion 772A can be increased.

The second right terminal member 770A is another example of the second terminal member. The sixth plate-shaped portion 772A is another example of the first electrical connection portion.

In the above-described embodiment, the first lead pins 722, 723 of the first heater 720 are respectively fixed to the first terminal members 740, 760 by welding. However, the first lead pins 722, 723 of the first heater 720 may be respectively fixed to the first terminal members 740, 760 by press-fit. The same applies to the second lead pins 732, 733 of the second heater 730.

In the above-described embodiment, the first terminal members 740, 760 are respectively fixed to the first fixing surfaces 912, 932 by the screws. However, for example, an insertion hole may be formed in each of the first fixing surfaces 912, 932 and the first terminal members 740, 760 may be respectively inserted into the insertion holes of the first fixing surfaces 912, 932 for fixation to the first fixing surfaces 912, 932. The same applies to the second terminal members 750, 770.

In the above-described embodiment, the second left terminal member 750 includes the second intermediate portion 753. However, the second intermediate portion 753 is not necessarily required for the second left terminal member 750. For example, the second plate-shaped portion 751 of the second left terminal member 750 may be directly connected to the second tip portion 754 extending along the first plate-shaped portion 741.

In the above-described embodiment, the first fixing surfaces 912, 932 and the second fixing surfaces 916, 936 are all formed on the top cover 900 as a frame. However, a frame formed with the first fixing surfaces 912, 932 and a frame formed with the second fixing surfaces 916, 936 may be provided separately.

In the above-described embodiment, the first tip portion 743 is disposed at a position not overlapping the fixing member 146 in the attachment direction DR1. However, the first tip portion 743 may be disposed on the upstream side in the attachment direction DR1 (rear side) of the fixing member 146. In comparison with a case in which the first tip portion 743 is disposed on the downstream side in the attachment direction DR1 (front side) of the fixing member 146, interference with the fixing member 146 can be suppressed even when the first tip portion 743 is disposed at a position overlapping the fixing member 146 in the attachment direction DR1, and the fixing device 700 can be easily attached to the printer 10.

The configuration of the printer 10 in the above-described embodiment is only an example and can be modified in various forms. In the above-described embodiment, the printer 10 performs printing operations using single-color (black) toner. However, the types of toner colors and the number of colors used for printing operations are not limited thereto.

The image forming apparatus is not limited to only the printer 10, but may be a copier, a facsimile machine, or a multi-function machine. The disclosure can be applied to the copier and the like.

In the above-described embodiment, a halogen heater is exemplified as the first heater 720 and the second heater 730 of the fixing device 700. However, an infrared heater or a carbon heater may be available for the first heater 720 and the second heater 730, for example.

While the description has been made in detail with reference to the embodiments thereof, it would be apparent to those skilled in the art that many modifications and variations may be made therein without departing from the spirit of the disclosure.

What is claimed is:

1. A fixing device comprising:

a first heater having one end portion;

a second heater having one end portion;

a frame including a first fixing surface and a second fixing surface;

a first terminal member to which the one end portion of the first heater is fixed, the first terminal member being electrically connected to the first heater, the first terminal member including:

a first plate-shaped portion having a plate shape and including a first fixed portion fixed to the first fixing surface of the frame; and a second terminal member to which the one end portion of the second heater is fixed, the second terminal member being electrically connected to the second heater, the second terminal member including:

a second plate-shaped portion having a plate shape and including a second fixed portion fixed to the second fixing surface of the frame; and a first electrical connection portion having a plate shape and electrically connected to a power source, the first electrical connection portion including:

a first intermediate portion bent from the second plate-shaped portion and extending in a first direction connecting the second fixed portion and the second fixing surface, the first intermediate portion having:

a first end in the first direction and connected to the second plate-shaped portion; and a second end opposite to the first end of the first intermediate portion in the first direction; and a first tip portion extending from the second end of the first intermediate portion along the first plate-shaped portion.

2. The fixing device according to claim 1, wherein the first heater is a halogen heater, and wherein the second heater is a halogen heater.

3. The fixing device according to claim 1, wherein the first tip portion is oriented in a second direction from the first fixed portion to the second fixed portion.

4. The fixing device according to claim 1, wherein the first plate-shaped portion has:

a first end in a second direction from the first fixed portion to the second fixed portion; and a second end opposite to and downstream relative to the first end of the first plate-shaped portion in the second direction, and wherein the first terminal member further includes a second electrical connection portion having a plate shape and electrically connected to the power source, the second electrical connection portion including:

a second intermediate portion bent from the second end of the first plate-shaped portion and extending in a third direction from the first fixed portion to the first fixing surface, the second intermediate portion having:

a first end in the third direction and connected to the second end of the first plate-shaped portion; and a second end opposite to the first end of the second intermediate portion in the third direction; and a second tip portion bent from the second end of the second intermediate portion and is oriented in the second direction.

5. The fixing device according to claim 4, wherein at least a part of the second tip portion overlaps the second fixed portion when viewed in the first direction.

6. The fixing device according to claim 5, wherein the second tip portion and the second fixed portion are positioned on opposite sides of the second fixing surface in the first direction.

7. The fixing device according to claim 1, wherein the first fixed portion and the second fixed portion are arrayed in an array direction, wherein the first terminal member further includes a second electrical connection portion having a plate shape and electrically connected to the power source, the second electrical connection portion including:

a second intermediate portion bent from the first plate-shaped portion and extending in a third direction from the first fixed portion to the first fixing surface, the second intermediate portion having:

a first end in the third direction and connected to the first plate-shaped portion; and a second end opposite to the first end of the second intermediate portion in the third direction; and a second tip portion extending from the second end of the second intermediate portion along the second plate-shaped portion, the second tip portion extending in the array direction and having:

a first end in the array direction and connected to the second intermediate portion; and a second end opposite to the first end of the second tip portion in the array direction, wherein the first tip portion extends in the array direction and has:

a first end in the array direction and connected to the first intermediate portion; and a second end opposite to the first end of the first tip portion in the array direction, and wherein the first tip portion extends from the first intermediate portion in a direction opposite to a direction in which the second tip portion extends from the second intermediate portion such that a distance in the array direction from the second end of the first tip portion to the second end of the second tip portion is greater than a distance in the array direction from the first end of the first tip portion to the first end of the second tip portion.

8. The fixing device according to claim 7, further comprising:

a first connector engageable with the second tip portion; and a second connector engageable with the first tip portion, wherein at least a part of the first connector overlaps the second connector in the array direction.

9. The fixing device according to claim 1, wherein the first fixed portion and the second fixed portion are arrayed in an array direction, wherein the first terminal member further includes a second electrical connection portion having a plate shape and electrically connected to the power source, the second electrical connection portion including:

a second intermediate portion bent from the first plate-shaped portion and extending in a third direction from the first fixed portion to the first fixing surface, the second intermediate portion having:

a first end in the third direction and connected to the first plate-shaped portion; and a second end opposite to the first end of the second intermediate portion in the third direction; and a second tip portion extending from the second end of the second intermediate portion along the second plate-shaped portion, the second tip portion extending in the array direction, wherein the first tip portion extends in the array direction, and wherein the second intermediate portion is oriented in a direction opposite to a direction in which the first intermediate portion is oriented.

10. A fixing device comprising:

a first heater including:

a first glass tube elongated in an elongated direction and having one end in the elongated direction;

a first heating body disposed inside the first glass tube; and a first lead pin protruding from the one end of the first glass tube and electrically connected to the first heating body;

a second heater including:

a second glass tube elongated in the elongated direction and having one end in the elongated direction;

a second heating body disposed inside the second glass tube; and a second lead pin protruding from the one end of the second glass tube and electrically connected to the second heating body;

a frame including a first fixing surface and a second fixing surface;

a first terminal having a plate shape and to which the first lead pin is fixed, the first terminal being electrically connected to the first lead pin, the first terminal including:

a first plate-shaped portion having a plate shape and including a first fixed portion fixed to the first fixing surface of the frame; and a second terminal having a plate shape and to which the second lead pin is fixed, the second terminal being electrically connected to the second lead pin, the second terminal including:

a second plate-shaped portion having a plate shape and including a second fixed portion fixed to the second fixing surface of the frame; and a first electrical connection portion having a plate shape and electrically connected to a power source, the first electrical connection portion including:

a first intermediate portion bent from the second plate-shaped portion and extending in a first direction connecting the second fixed portion and the second fixing surface, the first intermediate portion having:

a first end in the first direction and connected to the second plate-shaped portion; and a second end opposite to the first end of the first intermediate portion in the first direction; and a first tip portion extending from the second end of the first intermediate portion along the first plate-shaped portion.

11. The fixing device according to claim 10, wherein the first heater is a halogen heater, and wherein the second heater is a halogen heater.

12. The fixing device according to claim 10, wherein the first tip portion is oriented in a second direction from the first fixed portion to the second fixed portion.

13. The fixing device according to claim 10, wherein the first plate-shaped portion has:

a first end in a second direction from the first fixed portion to the second fixed portion; and a second end opposite to and downstream relative to the first end of the first plate-shaped portion in the second direction, and wherein the first terminal member further includes a second electrical connection portion having a plate shape and electrically connected to the power source, the second electrical connection portion including:

a second intermediate portion bent from the second end of the first plate-shaped portion and extending in a third direction from the first fixed portion to the first fixing surface, the second intermediate portion having:

a first end in the third direction and connected to the second end of the first plate-shaped portion; and a second end opposite to the first end of the second intermediate portion in the third direction; and a second tip portion bent from the second end of the second intermediate portion and is oriented in the second direction.

14. The fixing device according to claim 13, wherein at least a part of the second tip portion overlaps the second fixed portion when viewed in the first direction.

15. The fixing device according to claim 14, wherein the second tip portion and the second fixed portion are positioned on opposite sides of the second fixing surface in the first direction.

16. The fixing device according to claim 10, wherein the first fixed portion and the second fixed portion are arrayed in an array direction, wherein the first terminal member further includes a second electrical connection portion having a plate shape and electrically connected to the power source, the second electrical connection portion including:

a second intermediate portion bent from the first plate-shaped portion and extending in a third direction from the first fixed portion to the first fixing surface, the second intermediate portion having:

a first end in the third direction and connected to the first plate-shaped portion; and a second end opposite to the first end of the second intermediate portion in the third direction; and a second tip portion extending from the second end of the second intermediate portion along the second plate-shaped portion, the second tip portion extending in the array direction and having:

a first end in the array direction and connected to the second intermediate portion; and a second end opposite to the first end of the second tip portion in the array direction, wherein the first tip portion extends in the array direction and has:

a first end in the array direction and connected to the first intermediate portion; and a second end opposite to the first end of the first tip portion in the array direction, and wherein the first tip portion extends from the first intermediate portion in a direction opposite to a direction in which the second tip portion extends from the second intermediate portion such that a distance in the array direction from the second end of the first tip portion to the second end of the second tip portion is greater than a distance in the array direction from the first end of the first tip portion to the first end of the second tip portion.

17. The fixing device according to claim 16, further comprising:

a first connector engageable with the second tip portion; and a second connector engageable with the first tip portion, wherein at least a part of the first connector overlaps the second connector in the array direction.

18. The fixing device according to claim 10, wherein the first fixed portion and the second fixed portion are arrayed in an array direction, wherein the first terminal member further includes a second electrical connection portion having a plate shape and electrically connected to the power source, the second electrical connection portion including:

a second intermediate portion bent from the first plate-shaped portion and extending in a third direction from the first fixed portion to the first fixing surface, the second intermediate portion having:

a first end in the third direction and connected to the first plate-shaped portion; and a second end opposite to the first end of the second intermediate portion in the third direction; and a second tip portion extending from the second end of the second intermediate portion along the second plate-shaped portion, the second tip portion extending in the array direction, wherein the first tip portion extends in the array direction, and wherein the second intermediate portion is oriented in a direction opposite to a direction in which the first intermediate portion is oriented.

* * * * *